United States Patent [19]

Di Tella et al.

[11] Patent Number: 4,611,550

[45] Date of Patent: Sep. 16, 1986

[54] SYSTEM FOR MOORING TANKERS TO A FIXED STRUCTURE

[75] Inventors: Vincenzo Di Tella; Roberto Brandi; Roberto Carraro, all of Padua, Italy

[73] Assignee: Tecnomare S.p.A., Venice, Italy

[21] Appl. No.: 638,673

[22] Filed: Aug. 8, 1984

[30] Foreign Application Priority Data

Aug. 12, 1983 [IT] Italy ..... 84135 A/83

[51] Int. Cl.[4] ..... B63B 21/00

[52] U.S. Cl. ..... 114/230; 141/387

[58] Field of Search ..... 114/230; 441/3-5; 141/387, 388

[56] References Cited

U.S. PATENT DOCUMENTS 4,351,260 9/1982 Tuson et al. ..... 114/230

4,441,448 4/1984 Hillberg ..... 114/230

*Primary Examiner*—Trygve M. Blix

*Assistant Examiner*—Jesûs D. Sotelo

*Attorney, Agent, or Firm*—Birch, Stewart, Kolasch & Birch

[57] ABSTRACT

A system for mooring tankers to an emergent fixed structure, constituted by an articulated connection structure using an equalizer hinged to the tanker deck by hinges able to isolate said articulated structure from the tanker rolling motion.

4 Claims, 3 Drawing Figures

SYSTEM FOR MOORING TANKERS TO A FIXED STRUCTURE

BACKGROUND OF THE INVENTION

This invention relates to a system which constitutes an improvement in the configuration for permanent open-sea mooring to a fixed structure in accordance with the invention "System for Mooring Tankers to a Fixed Structure", filed on Mar. 12, 1984 under No. 588.459 in USA.

SUMMARY OF THE INVENTION

Although still retaining the general operating principle of the system described in said invention, the configuration according to the present invention differs therefrom in that the equaliser necessary for isolating the tanker rolling motion is disposed on the tanker itself instead of on the swinging boom.

BRIEF DESCRIPTION OF THE DRAWINGS

The present invention is described hereinafter by way of example, without this limiting the possibility of making modifications which do not change the substance of the invention itself, and with reference to FIGS. 1, 2 and 3, in which.

DETAILED DESCRIPTION OF PREFERRED EMBODIMENT

Figure 1:
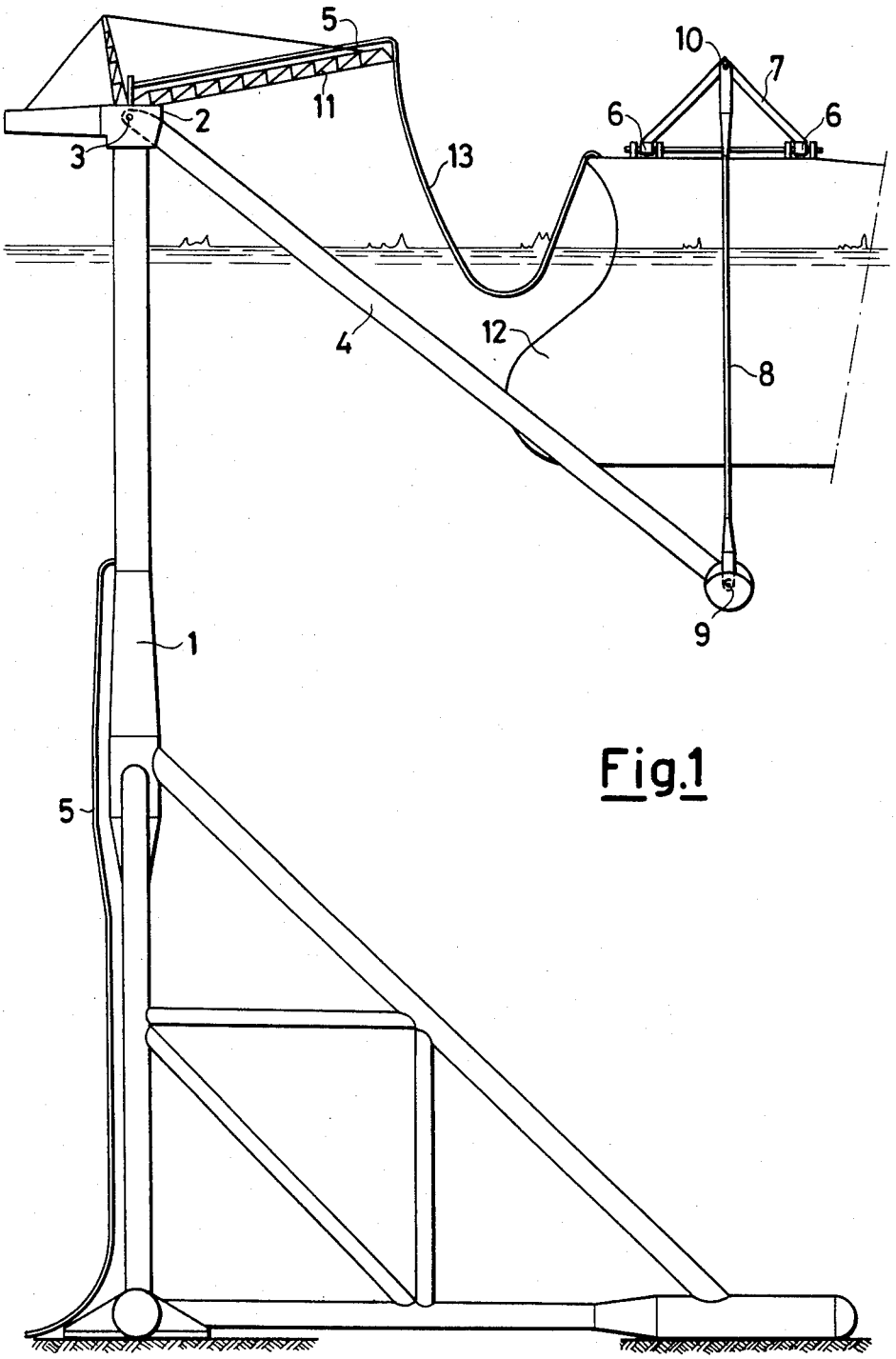
FIG. 1 is a general view of the system
Figure 2:
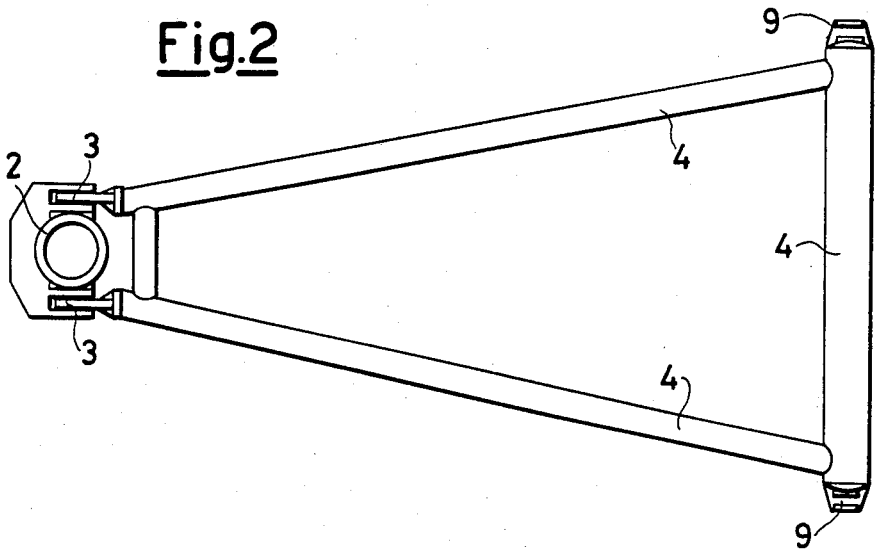
FIGS. 2 and 3 are respectively a plan view and a section on a vertical plane of the articulated structure which connects the tanker to the fixed structure.
Figure 3:
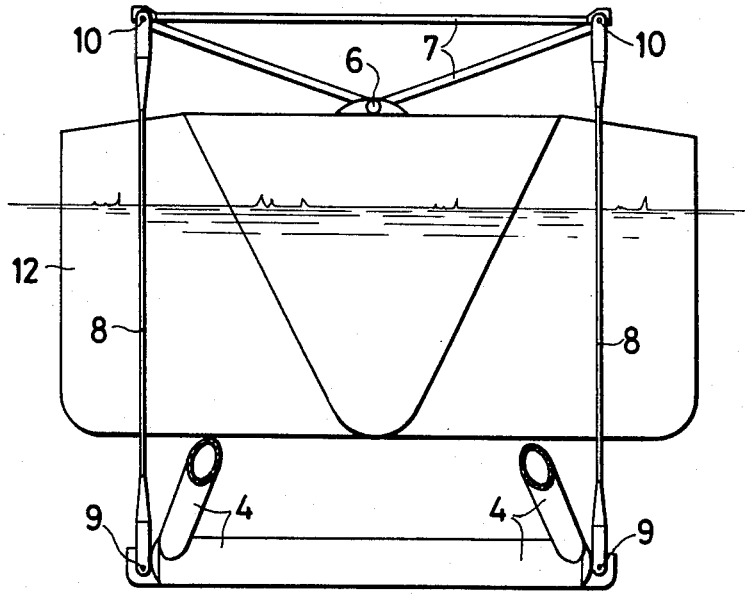

The system is constituted by a swinging boom 4 which is hinged to a fixed structure 1 whether of the gravity or pile foundation type, by means of two hinges 3 of horizontal axis and a thrust bearing 2 of vertical axis.

The swinging boom 4 comprises ballast chambers, the weight of which is able to provide the elastic return force for the system. The two ties 8 are connected to the boom by means of the hinges 9. The other end of the ties is connected by hinges 10 to the equaliser 7, this being necessary for isolating the system from the rolling motion of the tanker 12.

The equaliser 7 is then hinged to the deck of the tanker 12 by means of the hinges 6. The tanker is loaded through flow lines 5 carried to the surface by the fixed structure 1 and then connected to flexible hoses 13 or articulated arms, supported by the lattice beam 11 pivoted to the rotatable thrust bearing 2.

In addition to the general advantages of the system described in the previous invention entitled "System for Mooring Tankers to a Fixed Structure", the improved system of the present invention provides the following advantages:

- it eliminates rotational oscillatory motion of the equaliser in the water: because of the inertial forces and the hydrodynamic resistance, such motion would result in dynamic over-stressing of the ties and hinges, and of the equaliser itself; the absence of such motion also enables hinges 9 and 10 of less critical construction to be used;
- it results in a very small number of mechanical members under water, with inspection and maintenance cost advantages.

We claim:

1. An improved system for mooring tankers to an emergent fixed structure fixed to the sea bed, comprising an articulated structure for connecting the tanker to the fixed structure, said structure including an equalizer hinged to the tanker deck by hinges able to isolate said articulated connection structure from the tanker rolling motion, said structure also including a swinging boom made up of ballast chamber, said swinging boom in said articulated connection structure is constituted by tubular rods and said structure further includes two ties hinged to said swinging boom.

2. The improved mooring system as claimed in claim 1, characterized in that said swinging boom moves about the vertical axis of rotation and about only one horizontal axis of rotation, namely that orthogonal to the vertical plane of symmetry of the system.

3. The improved mooring system as claimed in claim 2, characterized by being connected to a fixed structure able to carry flow lines from the sea bed to the surface.

4. The improved mooring system as claimed in claim 1, characterized by being connected to a fixed structure able to carry flow lines from the sea bed to the surface.

* * * * *